US006302352B1

(12) United States Patent
Applegate

(10) Patent No.: US 6,302,352 B1
(45) Date of Patent: Oct. 16, 2001

(54) WARNING TAPE DISPENSER AND CARRIER

(76) Inventor: Albert H. Applegate, #6 Pendleton Dr., Berlin, NJ (US) 08009

( * ) Notice: Subject to any disclaimer, the term of this patent is extended or adjusted under 35 U.S.C. 154(b) by 0 days.

(21) Appl. No.: 09/498,689

(22) Filed: Feb. 7, 2000

(51) Int. Cl.[7] ..... B65H 75/00

(52) U.S. Cl. ..... 242/588.2; 242/129.53; 242/405.3; 242/588.3; 242/596.4; 242/596.7; 242/599.3

(58) Field of Search ..... 242/588, 588.1, 242/588.2, 588.3, 588.6, 596.7, 596.8, 398, 405, 405.3, 596, 596.4, 407.1, 599.3, 129.51, 129.53

(56) References Cited

U.S. PATENT DOCUMENTS

| | | | | |
|---|---|---|---|---|
| 446,487 | | 2/1891 | Vannatta . | |
| 1,447,538 | | 3/1923 | Fullington . | |
| 1,554,082 | | 9/1925 | Gerould . | |
| 1,896,741 | | 2/1933 | Crandall . | |
| 1,990,135 | | 2/1935 | Sato . | |
| 2,324,796 | * | 7/1943 | Neptune . | |
| 2,905,404 | * | 9/1959 | Simmons . | |
| 4,535,947 | * | 8/1985 | Hidle | 242/129.51 X |
| 4,600,162 | * | 7/1986 | Hidle | 242/129.51 X |
| 5,641,109 | | 6/1997 | Willoughby | 225/20 |
| 5,735,400 | * | 4/1998 | Packard | 242/588.6 X |
| 5,738,297 | * | 4/1998 | Bailey et al. | 242/588.6 X |
| 5,878,932 | * | 3/1999 | Huang | 242/588 X |

* cited by examiner

*Primary Examiner*—William A. Rivera
(74) *Attorney, Agent, or Firm*—John H Scarborough; Robert R Mallinckrodt

(57) ABSTRACT

A device for dispensing and carrying tape having a C-shaped handle where both ends have openings. Two cylinders inserted through each of the openings form a spindle by which to dispense and carry tape. Each cylinder has a J-slot cut into its side to receive an engaging screw which attaches through the C-shaped handle. By turning each cylinder one way, the cylinders form a spindle by which to hold a roll of warning (or caution) tape. By turning the cylinder each the other way, the cylinders retract to allow installation of a new warning tape roll.

11 Claims, 4 Drawing Sheets

WARNING TAPE DISPENSER AND CARRIER

BACKGROUND OF THE INVENTION

1. Field

This invention is in the field of tape dispensers, more particularly, warning tape dispensers.

2. State of the Art

Police, fire fighters, and construction people use warning (or caution) tape to "rope" out people from hazardous areas. Warning tapes are rolled up within themselves without benefit of a spool. Dispensing warning tape without a spool is difficult and awkward to accomplish.

There are tape dispensing devices which have been developed in the past. Willoughby, U.S. Pat. No. 5,641,109, discloses a belt-mounted tape dispenser.

Other prior art provide for dispensing other types of material. Sato, U.S. Pat. No. 1,990,135, provides a wire handling device. Crandall, U.S. Pat. No. 1,896,741, discloses a carrying reel for fishing line. Gerould, U.S. Pat. No. 1,554,082, discloses a twine holder. Fullington, U.S. Pat. No. 1,447,538, provides a tension device for rope making machines. Vannatta, U.S. Pat. No. 4,46,487, discloses a wire reel for taking up wire from temporary fences and unreeling wire for the erection of fences.

Warning (or caution) tapes are manufactured in rolls. Of the known prior art, there have been no devices which have been invented to dispense and carry warning tapes, probably because it would be necessary to unroll the tape first and then to reroll it onto a dispensing device. Further, no tape dispensing device has been designed that provides for retractable cylinders, which act in concert as a spindle, to allow tape to be mounted for dispensing without having to unroll and to reroll the tape first.

OBJECTS OF THE INVENTION

An object of this invention is to provide a device to allow tape to be mounted for dispensing without first unrolling the tape and then rerolling it onto the device. Another object of this invention is to provide a device which can easily carry tape as the tape is being dispensed. Still another object of this device is to enable a user to carry rolls of big, bulky tape; it is primarily contemplated that this invention would be used to carry and dispense warning tape.

SUMMARY OF THE INVENTION

This invention is a dispenser and carrier for tape, primarily warning tape; it allows the user to dispense warning tape while a tape roll is being carried. For purposes of description, the warning tape dispenser and carrier is comprised of a handle the ends of which are folded toward each other to form a C-shape. The ends also have openings for inserting cylinders which form a spindle to hold rolls of warning tape. The cylinders are retracted to allow insertion of the rolls of new warning tape after an old tape has been used.

BRIEF DESCRIPTION OF THE DRAWINGS

The best mode presently contemplated for carrying out the invention in actual practice is shown in the accompanying drawings, in which.

DETAILED DESCRIPTION OF THE ILLUSTRATED EMBODIMENT

Figure 1:
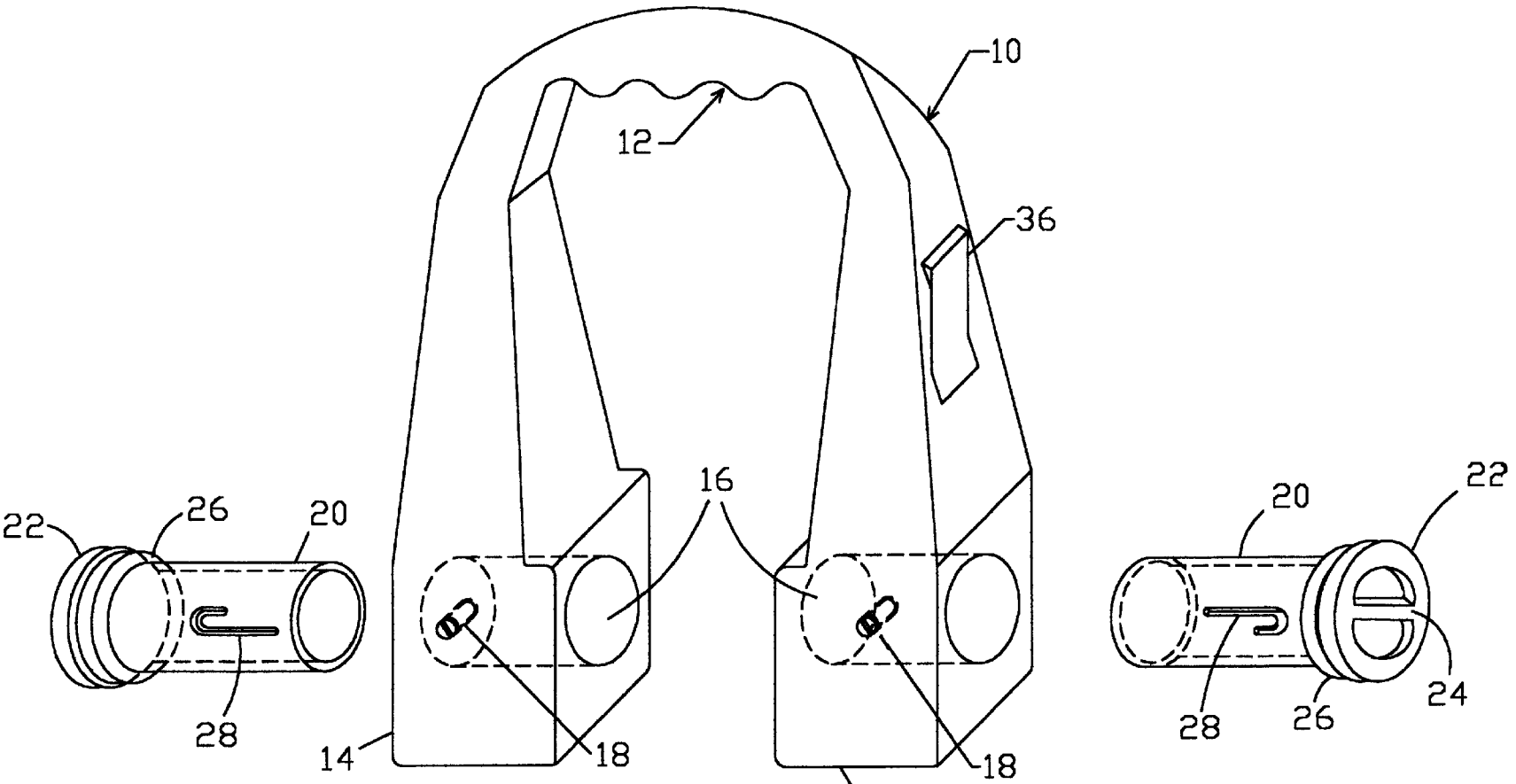
FIG. 1 is an exploded view of a tape dispenser and carrier.

In the illustrated embodiment, the warning tape dispenser is a device 10 folded into a C shape forming a handle at its center also forming opposing ends 14, FIG. 1. The ends 14 of the handle have openings 16 through which cylinders 20 are inserted to form a spindle which holds warning tape 34, FIG. 2. The handle 10 can be constructed with grooves 12 to facilitate gripping with the fingers, and a clip 36 can be installed on the side of the handle 10 to enable a handle 10 to be attached to a belt (not shown), FIGS. 1 and 2. Each cylinder 20 is constructed with a J-slot 28, through which to insert an engaging screw 18, and a turning cap 22, attached to the end of the cylinders 20, FIGS. 1, 2, and 5. FIG. 4 shows that the J-slot 28 of cylinder 20 has a short leg 30, a long leg 32, and a connecting loop 44. FIG. 1 shows that the turning cap 22, located at the end of the cylinder 20, has a ridge 24 to allow fingers to engage and turn the turning cap 22. A resilient material which forms a ring 26 around the cylinder 20 abutted to the turning cap 22 acts as a compressible washer 26 between the turning cap 22 and the handle 10 when the cylinder 20 is inserted into the opening 16 of the handle 10, FIG. 2. The compressible washer 26 also may be permanently attached, abutted to the turning cap 22. The purpose of the compressible washers 26 are to provide tension between the turning caps 22 and the end 14 of handles 10 when the engaging screws 18 are seated at the ends 47 of the short legs 30 of the J-slots 28 to keep both cylinders 20 securely positioned in the handle 10, thus forming a spindle for mounting a tape for dispensing and carrying, FIGS. 2 and 5. When both caps 22 are turned in the opposite direction to allow the engaging screws 18 to come to rest at the ends 47 of the long legs 32 of the J-slots 28, FIGS. 3 and 5, the cylinders 20 are retracted thereby by allowing an old tape to be removed and a new tape to be mounted. Resilient material of the washer 26 can be rubber, sponge rubber, or similar material.

Figure 3:
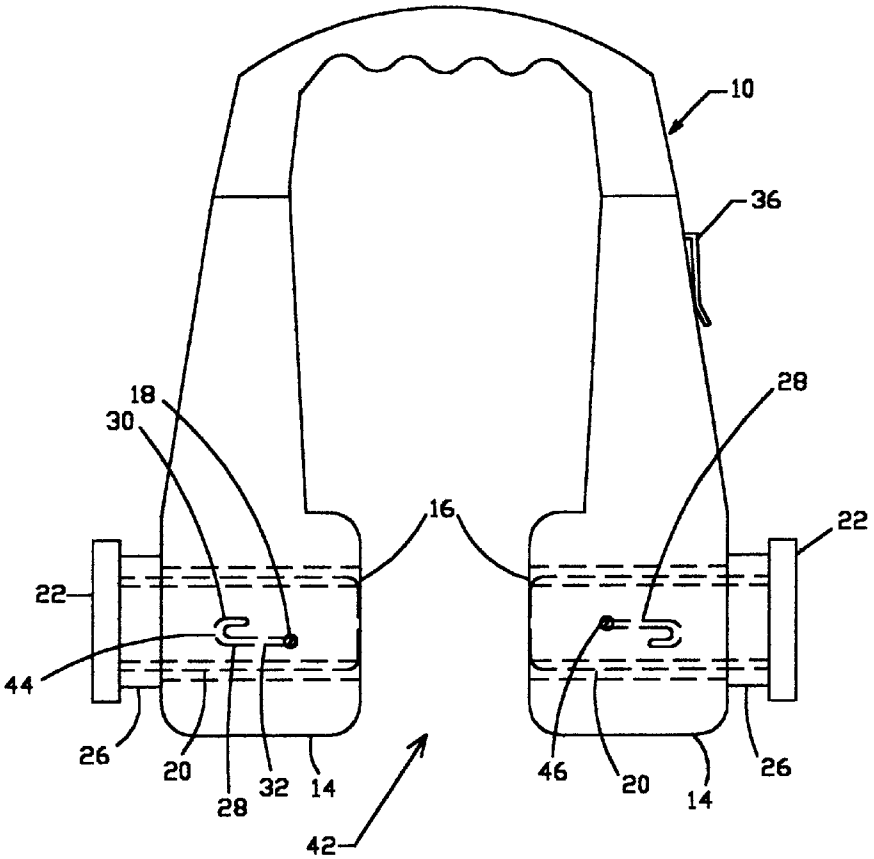
FIG. 3 is another front elevation of the tape dispenser and carrier without the tape installed.
Figure 2:
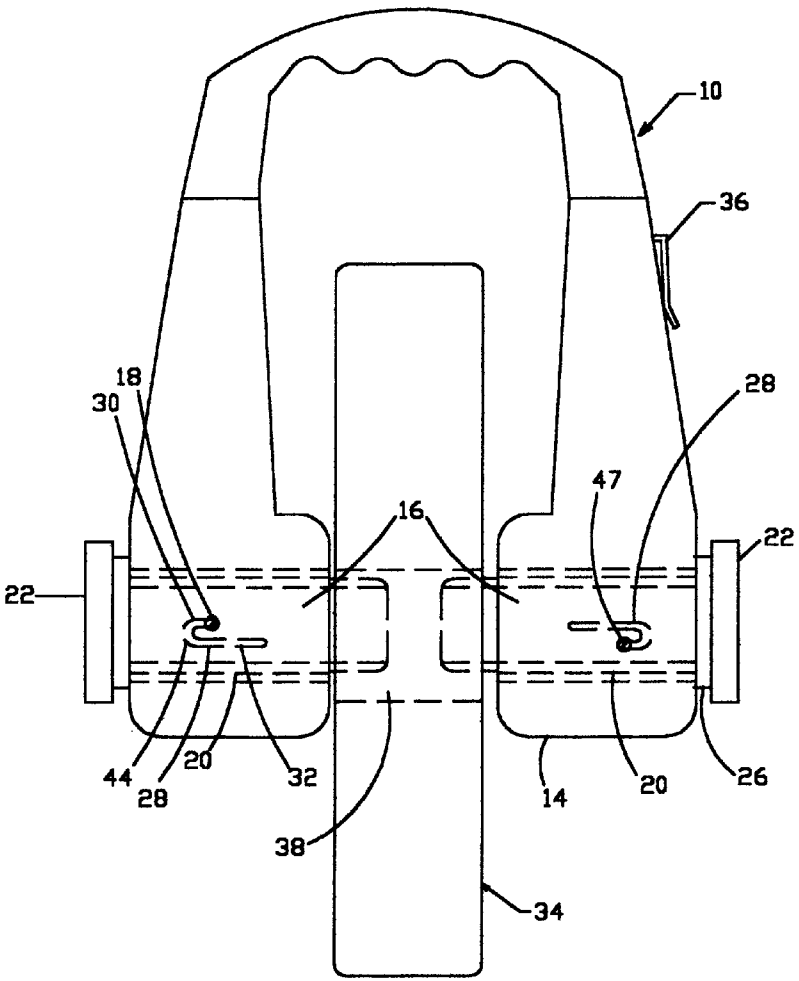
FIG. 2 is a front elevation of the tape dispenser and carrier with tape installed.
Figure 4:
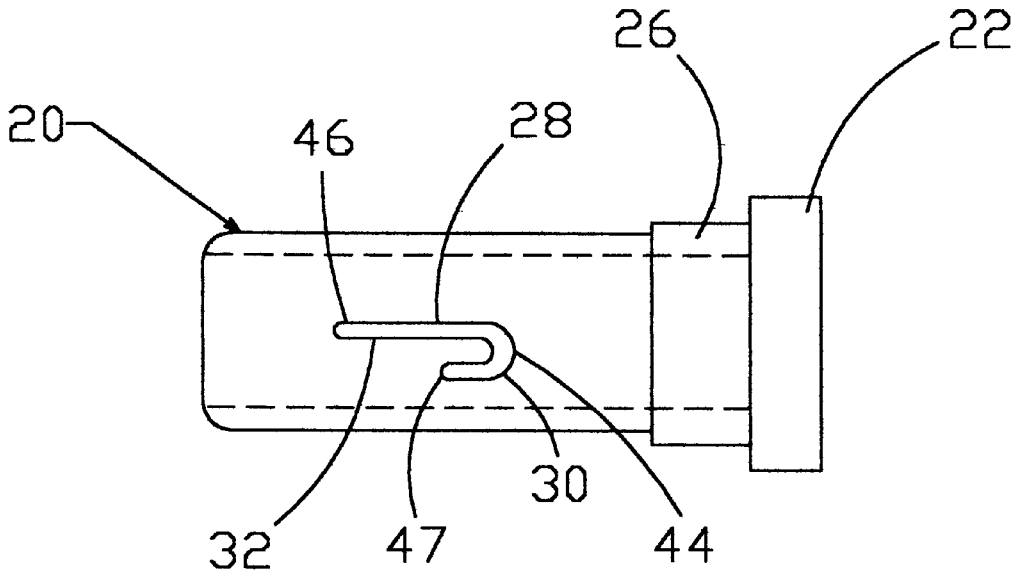
FIG. 4 is a side elevation of the cylinder of the tape dispenser and carrier.
Figure 5:
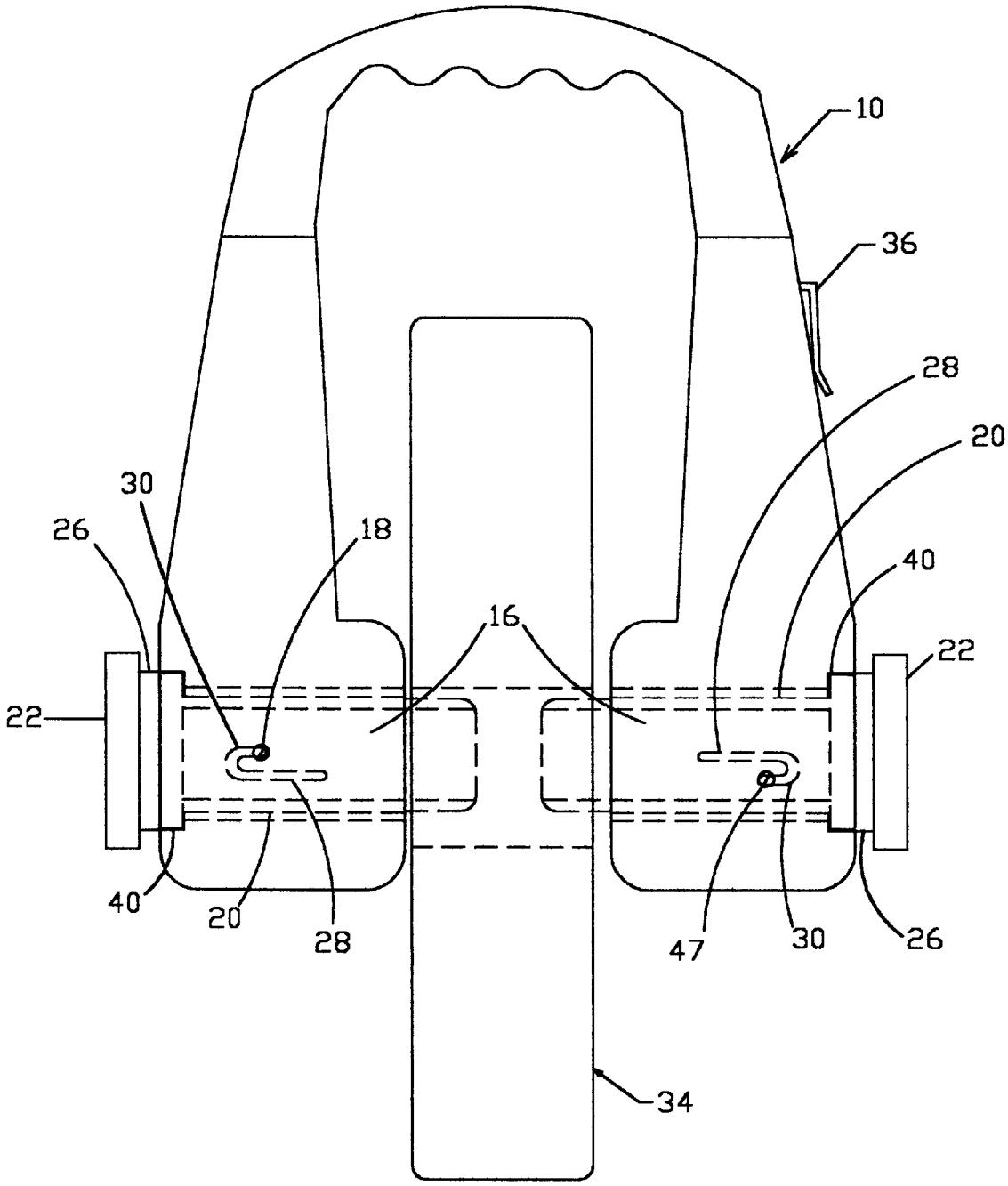
FIG. 5 is a front elevation of another embodiment of the tape dispenser with tape installed.

To close the cylinders to install a warning tape roll 34 for dispensing and carrying, it is first necessary that a tape roll 34 to be positioned in the space 42 between the ends 14 of the handle 10, FIG. 3. Then, with the engaging screw 18 extending into the J-slot 28, the cylinder 20 is turned clockwise, by turning cap 22, while the cylinder 20 is being inserted into the opening 16 as far as necessary to allow the engaging screw 18 to seat at the end 47 of the short leg 30 of the J-slot 28 in order to hold the cylinder closed, FIG. 2. FIG. 2 shows both cylinders 20 inserted through openings 16 of each side of the handle 10 to form a spindle through the hollow center 38 of the warning tape roll 34 to hold the tape roll 34 for dispensing and carrying. The resilient material of the compressible washer 26 provides tension between the turning cap 22 and the outside of the end 14 of handle 10 enough such that the engaging screw 18 will stay seated in the end 47 of the short leg 30 of the J-slot 28, FIG. 2. In another embodiment, a depressed annular well 40 can be employed to receive and hold the compressible washer 26, FIG. 5. FIG. 5 shows cylinders 20 inserted through openings 16 also to form a spindle to hold tape roll 34 for dispensing and carrying, with engaging screws 18 seated at the ends 47 of the short legs 30 of J-slots 28. By performing a similar operation on the other cylinder 20, both cylinders 20 form a spindle by which to hold a roll 34 of warning tape, FIGS. 2 and 5. It should be understood that the slot by which to guide and seat the engaging screw 18 could be a reverse J shape (not shown) whereby the sense of turning the cylinder to hold and release the cylinder would be reversed.

To open the cylinders to remove or replace a roll of tape 34 from device 10, the cylinders 20 are retracted by turning each cap 22 counterclockwise (in the embodiment shown) until the engaging screws 18 are now seated at the ends 46 of long legs 32 of each J-slots 28, FIG. 3. Again, resilient material of the compressible washer 26 should provide enough tension between the turning cap 22 and the end 14 to allow each cylinder 20 to be held open so that an old roll can be removed and/or a new tape roll 34 can be installed, FIG. 3. The engaging screw 18 does not necessarily need to be seated at the far end 46 of the long leg 32 of the J-slot 28 to keep the cylinder open as shown in FIG. 3. It is only necessary that the length of the cylinder 20 or the position of the long leg 32 of the J-slot 28 be such that the cylinders 14 are completely open and not extending into the space between the ends 14 when the washers 26 are relaxed and not in a compressed state (not shown).

Figure 6:
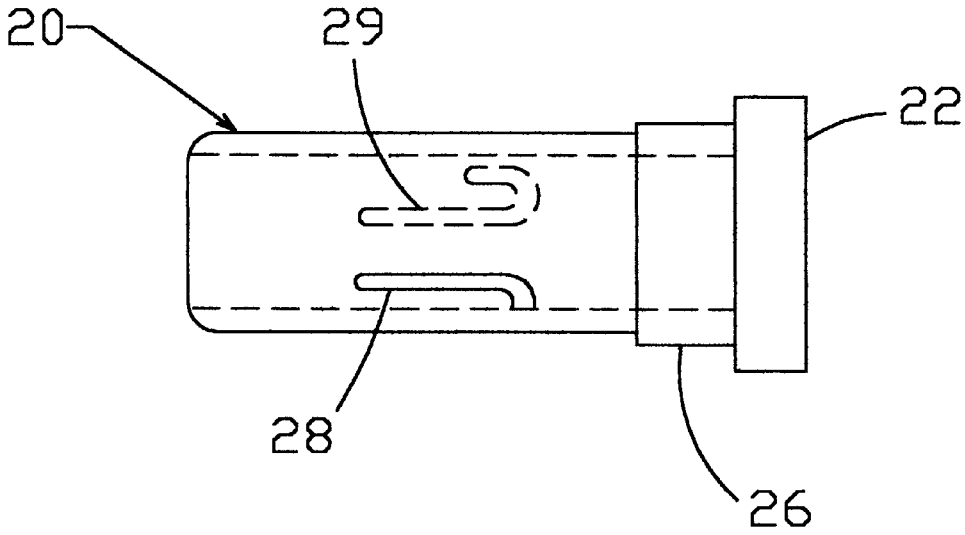
FIG. 6 is a side elevation of another embodiment of the cylinder of the tape dispenser and carrier.

FIG. 6 shows another embodiment of a cylinder 20 with an additional J-slot 29 cut into its side 180 degrees opposite the original J-slot 28. In order to keep the cylinders aligned within the center of a tape roll to keep the cylinders from jamming, whether open or closed, additional engaging screws can be employed on what would be the reverse sides of FIGS. 2 and 3 of the ends of the handle. Views of this embodiment are not shown because they would be similar to FIGS. 2, 3, and 5.

Although the figures, FIGS. 1, 2, 3, 4, 5, and 6, appropriately show how to make and use this invention, and the best mode known, they are not drawn exactly to scale. It should be understood that FIGS. 1 and 3 show the compressible washers 26 in there relaxed condition, i.e., not compressed with cylinders 20 open, while FIGS. 2 and 5 show the compressible washers 26 in there compressed condition, i.e., compressed holding the cylinders 20 closed. It also should be understood that, while FIGS. 2 and 3 are not drawn to scale, the cylinders 20, shown in FIG. 2 in closed position, are exactly the same cylinders 20, shown in FIG. 3 in open position, with the same dimensions.

While specific constructions and materials for the invention have been disclosed, various materials and constructions could be used. The present invention has been disclosed in connection with the preferred embodiment thereof, it should be understood that there may be other embodiments which fall within the spirit and scope of the invention as defined by the following claims.

I claim:

1. A device for dispensing and carrying tape, comprising:

a C-shaped handle having a central hand grip portion and opposite end portions positioned to form a tape roll receiving space between the opposite end portions;

an opening extending through each end portion, the openings in each end portion being substantially aligned;

a cylinder slidably received in each opening movable between an open position wherein the cylinders are retracted into the respective handle end portions to leave the tape roll receiving space between the handle end portions open so a roll of tape can be inserted into or withdrawn from the tape roll receiving space, and a closed position wherein the cylinders extend toward one another into the tape roll receiving space between the handle end portions to take and hold the roll of tape in said space; and a J-slot cut into the side of each cylinder, each J-slot having a short leg, a long leg, and connecting loop, and an engaging screw extending from each end portion of the handle into the J-slot of each cylinder, each engaging screw seated at the end of the short leg of each J-slot for holding the cylinders in the closed position to allow a user to dispense and carry tape and seated at the end of the long leg of each J-slot for holding the cylinders in the open position to allow the user to remove an old tape roll and install a new tape roll.

2. A device for dispensing and carrying tape according to claim 1 wherein each cylinder has a turning cap attached to the end of each said cylinder.

3. A device for dispensing and carrying warning tape according to claim 1 wherein the device is used to dispense and carry warning tape.

4. A device for dispensing and carrying tape according to claim 1 wherein the are two additional J-slots, each additional J-slot cut into the side of each cylinders, 180 degrees from the original J-slots, and two additional engaging screws, each additional engaging screw extending from each handle end portion on the reverse side of each handle end portion opposing the original engaging screws.

5. A device for dispensing and carrying tape, comprising:

a C-shaped handle having a central hand grip portion and opposite end portions positioned to form a tape roll receiving space between the opposite end portions;

an opening extending through each end portion, the openings in each end portion being substantially aligned;

a cylinder slidably received in each opening movable between an open position wherein the cylinders are retracted into the respective handle end portions to leave the tape roll receiving space between the handle end portions open so a roll of tape can be inserted into or withdrawn from the tape roll receiving space, and a closed position wherein the cylinders extend toward one another into the tape roll receiving space between the handle end portions to take and hold the roll of tape in said space, each cylinder having a turning cap attached to the end of each said cylinder wherein each turning cap is constructed with a ridge thereon to allow fingers to engage and turn said turning cap; and means for holding the cylinders in the closed position to allow a user to dispense and carry tape, and holding the cylinders in the open position to allow the user to remove an old tape roll and install a new tape roll.

6. A device for dispensing and carrying tape, comprising:

a C-shaped handle having a central hand grip portion and opposite end portions positioned to form a tape roll receiving space between the opposite end portions;

an opening extending through each end portion, the openings in each end portion being substantially aligned;

a cylinder slidably received in each opening movable between an open position wherein the cylinders are retracted into the respective handle end portions to leave the tape roll receiving space between the handle end portions open so a roll of tape can be inserted into or withdrawn from the tape roll receiving space, and a closed position wherein the cylinders extend toward one another into the tape roll receiving space between the handle end portions to take and hold the roll of tape in said space, each cylinder having a turning cap attached to the end of each said cylinder wherein there is resilient material abutted to each turning cap forming a ring around each cylinder which acts as a compressible washer between each said turning cap and the handle end portion of the device when each said cylinder is slidably received into each end portion of the device; and means for holding the cylinders in the closed position to allow a user to dispense and carry tape, and holding the cylinders in the open position to allow the user to remove an old tape roll and install a new tape roll.

7. A device for dispensing and carrying tape according to claim 6 wherein the resilient material is rubber.

8. A device for dispensing and carrying tape according to claim 6 wherein the resilient material is sponge rubber.

9. A device for dispensing and carrying tape, comprising:

a C-shaped handle having a central hand grip portion and opposite end portions positioned to form a tape roll receiving space between the opposite end portions wherein a clip for a belt is attached to the C-shaped handle;

an opening extending through each end portion, the openings in each end portion being substantially aligned;

a cylinder slidably received in each opening movable between an open position wherein the cylinders are retracted into the respective handle end portions to leave the tape roll receiving space between the handle end portions open so a roll of tape can be inserted into or withdrawn from the tape roll receiving space, and a closed position wherein the cylinders extend toward one another into the tape roll receiving space between the handle end portions to take and hold the roll of tape in said space; and means for holding the cylinders in the closed position to allow a user to dispense and carry tape, and holding the cylinders in the open position to allow the user to remove an old tape roll and install a new tape roll.

10. A device for dispensing and carrying tape, comprising:

a C-shaped handle having a central hand grip portion and opposite end portions positioned to form a tape roll receiving space between the opposite end portions wherein grooves are constructed in the central hand grip portion of the C-shaped handle to facilitate gripping the handle with the fingers;

an opening extending through each end portion, the openings in each end portion being substantially aligned;

a cylinder slidably received in each opening movable between an open position wherein the cylinders are retracted into the respective handle end portions to leave the tape roll receiving space between the handle end portions open so a roll of tape can be inserted into or withdrawn from the tape roll receiving space, and a closed position wherein the cylinders extend toward one another into the tape roll receiving space between the handle end portions to take and hold the roll of tape in said space; and means for holding the cylinders in the closed position to allow a user to dispense and carry tape, and holding the cylinders in the open position to allow the user to remove an old tape roll and install a new tape roll.

11. A method to secure a warning tape to and release the warning tape from a device for dispensing and carrying the warning tape, comprising the steps of:

obtaining a roll of warning tape, positioning the roll of warning tape in a receiving space between opposite end portions of the device formed by folding said device into a C-shape with two cylinders each inserted through openings at the end portions thereof, each said cylinder having a washer made of resilient material abutted to a turning cap attached to the end of said cylinder and having a J-slot through which to insert an engaging screw extending from each end portion of said device, each said J-slot having a short leg, a long leg, and connecting loop;

turning each turning cap while compressing the washer of each cylinder in a direction to seat the engaging screw at the end of the short leg of each J-slot thereof in order to hold and secure the warning tape for carrying and dispensing; and turning the turning cap while compressing the washer of each cylinder in a direction to position the engaging screw in the long leg of the J-slot thereof to release the warning tape from the device in order to ready the device for securing another warning tape.

* * * * *